United States Patent [19]

Lancaster et al.

[11] Patent Number: 4,490,648

[45] Date of Patent: Dec. 25, 1984

[54] STABILIZED RADIO FREQUENCY QUADRUPOLE

[75] Inventors: Henry D. Lancaster, Orinda; Jock A. Fugitt, Berkeley; Donald R. Howard, Danville, all of Calif.

[73] Assignee: The United States of America as represented by the United States Department of Energy, Washington, D.C.

[21] Appl. No.: 426,363

[22] Filed: Sep. 29, 1982

[51] Int. Cl.[3] ..... H01J 25/10

[52] U.S. Cl. ..... 315/5.41; 250/396 R; 313/361.1; 328/233

[58] Field of Search ..... 315/5.41, 5.42; 330/4.6, 4.7; 250/396 R; 328/233; 313/361.1, 414

[56] References Cited

U.S. PATENT DOCUMENTS

| | | | |
|---|---|---|---|
| 2,943,235 | 6/1960 | Dunsmuir | 315/39.69 |
| 3,128,432 | 4/1964 | Gordon | 330/4.7 X |
| 3,131,359 | 4/1964 | Adler et al. | 330/4.7 |
| 3,252,104 | 5/1966 | Gordon | 330/4.7 |
| 3,296,484 | 1/1967 | Feinstein | 315/5 X |
| 3,304,461 | 2/1967 | Prine | 330/4.7 X |
| 3,482,136 | 12/1969 | Herrera | 313/63 |
| 3,553,451 | 1/1971 | Uthe | 250/41.9 |
| 3,665,245 | 5/1972 | Schwarz | 315/111 |
| 4,032,782 | 6/1977 | Smith et al. | 250/292 |
| 4,075,488 | 2/1978 | Okayama et al. | 250/396 |
| 4,350,927 | 9/1982 | Maschke | 315/5.53 |
| 4,360,760 | 11/1982 | Brodowski | 315/5.41 |
| 4,404,495 | 9/1983 | Müller | 315/5.41 |

FOREIGN PATENT DOCUMENTS

| | | | |
|---|---|---|---|
| 888913 | 2/1962 | United Kingdom | 330/4.7 |

*Primary Examiner*—Saxfield Chatmon

*Attorney, Agent, or Firm*—Clifton E. Clouse, Jr.; Roger S. Gaither

[57] ABSTRACT

A long-vane stabilized radio frequency resonator for accelerating charged particles and including means defining a radio frequency resonator cavity, a plurality of long vanes mounted in the defining means for dividing the cavity into sections, and means interconnecting opposing ones of the plurality of vanes for stabilizing the resonator.

7 Claims, 5 Drawing Figures

STABILIZED RADIO FREQUENCY QUADRUPOLE

The U.S. Government has rights in this invention pursuant to Contract No. DE-AC03-76SF00098 (formerly Contract No. W-7405-ENG-48) between the U.S. Department of Energy and the University of California for operation of the Lawrence Berkeley Laboratory.

BACKGROUND OF THE INVENTION

The present invention relates to stabilization of radio frequency quadrupoles, and more particularly, it relates to stabilization of a radio frequency quadrupole that includes vanes such as used for accelerating charged particles.

Radio frequency quadrupole (RFQ) devices have a number of uses. One such use is as a charged particle accelerator which is especially useful for ion implantation, nuclear medicine, fusion research, and, in general, any work requiring low and medium energy ions. RFQ devices are simple and convenient to use as accelerators since charged particles, in particular low-beta ions, may be simulataneously bunched, focused and accelerated. However, in order to be fully useful as a practical particle accelerator, an RFQ device should be reliable, easy to tune and drive, and dependable in its frequency and mode characteristics; and beam loading due to high currents should not cause severe unbalance of the quadrant fields of an RFQ device.

The general design of an RFQ particle accelerator known in the art is shown and described in a paper by Hansborough, Potter and Wilson in "Mechanical Design of RFQ Resonator Cavities In The 400-MHz Frequency Range", Los Alamos National Laboratory, Los Alamos, N. Mex. 87545, February 1982, and incorporated herein by reference. In this paper, some basic tuning methods of an RFQ accelerator are discussed. It will be noted, however, that these methods require complex mechanisms and that the RFQ cavities, often require frequent tuning due primarily to relative mechanical shifting of the cavity parts such as results from thermal effects during construction and operation.

SUMMARY OF THE INVENTION

It is an object of the invention to stabilize a radio frequency quadrupole of the long-vane type.

Another object is to arrange a long-vane radio frequency quadrupole to be reliable in operation, simple to tune and drive, and dependable in its frequency and mode characteristics.

Another object is to minimize any unbalance of the quadrant fields of a long-vane radio frequency quadrupole from beam loading due to high currents.

Another object is to provide a long-vane radio frequency quadrupole that is minimally influenced by mechanical and thermal effects during construction and operation.

Another object is to simply tune a long-vane radio frequency quadrupole.

In brief, the invention relates to a long-vane stabilized radio frequency resonator for accelerating charged particles and includes means defining a radio frequency resonator cavity, a plurality of long vanes mounted in the defining means for dividing the cavity into sections, and means interconnecting opposing ones of the plurality of vanes for stabilizing the resonator.

Other objects and advantageous features of the invention will be apparent in a description of a specific embodiment thereof, given by way of example only, to enable one skilled in the art to readily practice the invention which is described hereinafter with reference to the accompanying drawing.

DETAILED DESCRIPTION OF THE INVENTION

Reference will now be made in detail to a preferred embodiment of the invention, an example of which is illustrated in the accompanying drawing. While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
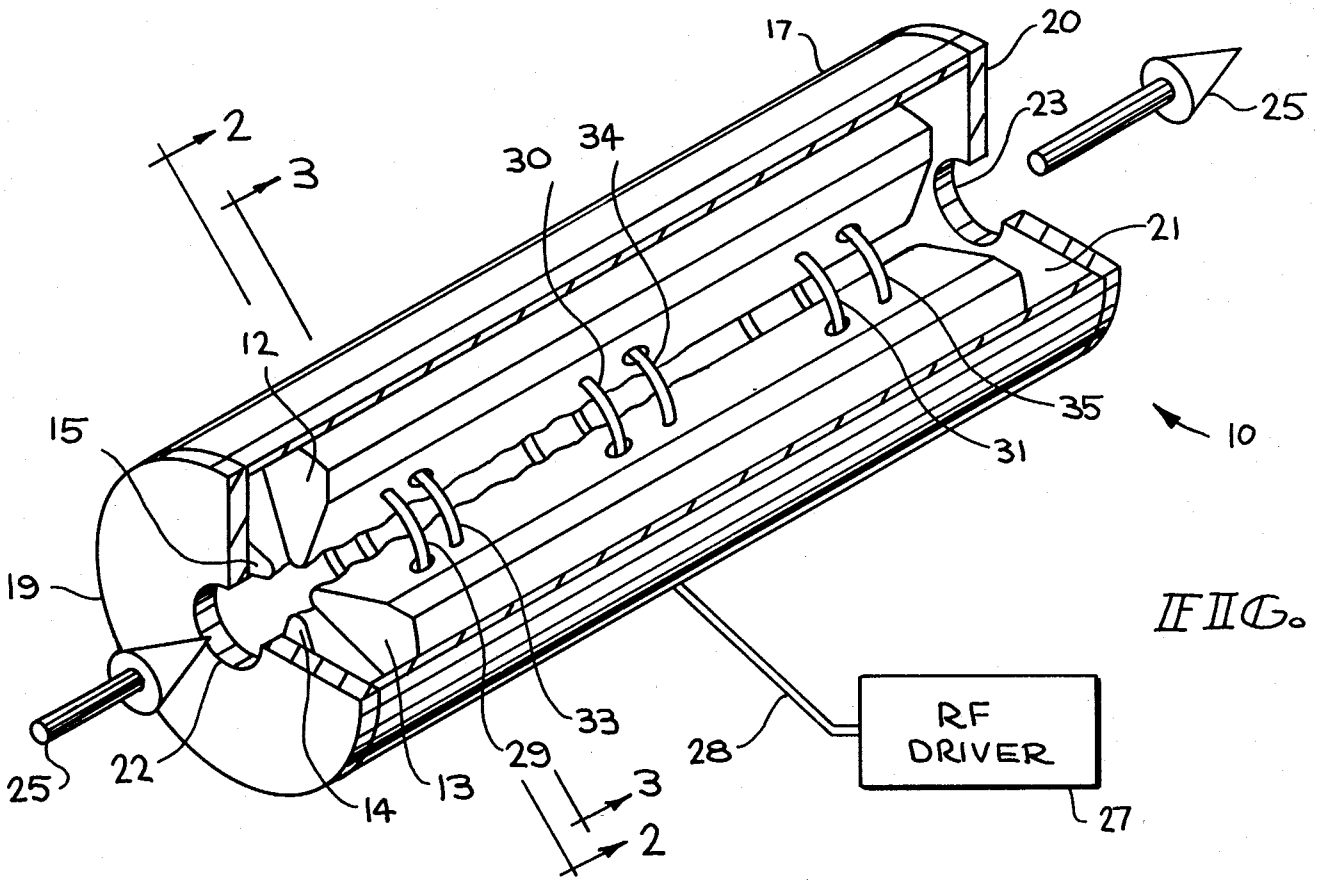
FIG. 1 is an isometric view, with portions broken away, of a long-vane radio-frequency quadrupole structure that is stabilized with coupling rings, according to the invention.

Referring now to the drawing, there is shown in FIG. 1 a stabilized radio frequency quadrupole (RFQ) structure 10 comprised of four long vanes 12, 13, 14, and 15, symmetrically mounted in quadruture within a cylindrical housing 17. The vanes 12–15 thereby comprise the four poles of the quadrupole structure 10. Disk-shaped end pieces 19 and 20 are secured to opposite ends of the housing 17 and, together with the housing, define an rf cavity 21. The end pieces are provided with holes 22 and 23 aligned with the central axis of the housing 17 for entrance and exit of an ion beam 25 that moves much more slowly than the velocity of light, into and from the housing 17. The ion beam 25 may be simultaneously bunched, focused and accelerated while passing through the RFQ structure 10. This is accomplished by means of energy transfer from a an rf driver 27 over a coaxial line 28 into the housing 17 where it is distributed within the cavity 21. Each of the vanes 12–15 are provided with conventional matching undulations that vary in length from the input end of the structure 10 at disk 19 to the output end at disk 20 to concentrate the energy between the vanes 12–15 along the beam path 25 and thereby simultaneously bunch, focus and accelerate the beam.

In order to achieve reliable, efficient, practical and effective acceleration, it is necessary to tune the RFQ structure and then stabilize the tuning. In the known art of long-vane RFQ structures, there have been severe difficulties in achieving such tuning and stabilization. As indicated in DOE technical report No. LBL-13008, "Loop Coupling To A Radio Frequency Quadrupole Resonator (RFQ)", D. Howard and H. Lancaster, Lawrence Berkeley Laboratory (LBL), University of California, Berkeley, Calif., 94720, Oct. 19, 1981, and incorporated herein by reference, several different modes, frequencies and amplitude distributions were observed simultaneously in the different quadrants of their long-vane RFQ, thereby showing that the quadrants were not closely coupled. The basic tuning methods known in the art for a long-vane RFQ, as indicated in the LBL report, include machining inserts and/or moving tuners at the ends of each vane, radially moving the vanes, circumferentially rocking the vanes, adjusting quadrant tuning slugs and mechanically deforming the resonator cavity. One such of these methods, involving vane movement, is set forth in the previously cited Los Alamos paper. In the Los Alamos device the vanes are moved within the cavity in order to tune the cavity. The Los Alamos solution includes providing each vane with a flexible vane-to-cavity rf joint so that each vane can be precisely rocked or moved and then held. Such joints require complex machining, manufacturing and assembly and still are found to be unstable and, in general, to be less than fully satisfactory. Tuning of such cavities must be precise and long-term stabilization is essential for practical long-term operation.

In accordance with the present invention, simple and very effective means are provided to closecouple the four quadrants of the RFQ structure 10 and to retain the close coupling even when there is shifting of components due to heat developed in the cavity during operation.

Figure 2:
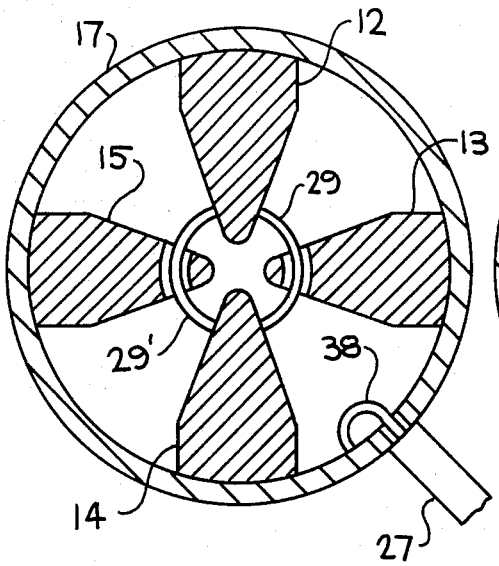
FIGS. 2 and 3 are views of the structure of FIG. 1 taken along lines 2—2 and lines 3—3, respectively, to clearly show the connection of the coupling rings to the vanes.
Figure 3:
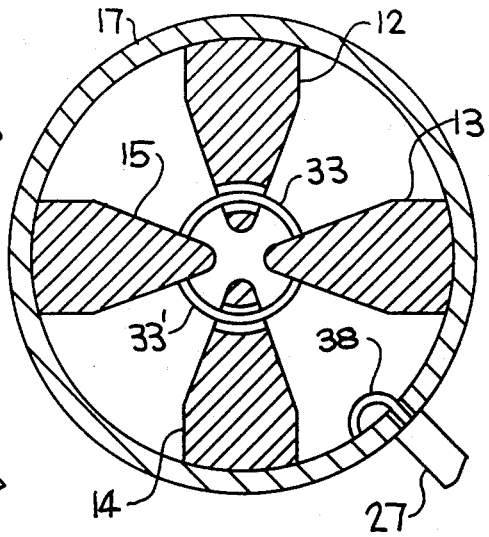

The close-coupling means of the invention includes electrically interconnecting opposing vanes 12 and 14, and 13 and 15, respectively, with electrically conductive means. The vanes 12 and 14 are connected by electrically conductive half-ring segments 29, 30 and 31, and the vanes 13 and 15 are connected by electrically conductive half-ring segments 33, 34 and 35 that are adjacent the segments 29, 30 and 31. The segments 29, 30 and 31 pass through holes in vane 13 that are larger in diameter than the thickness of the segment so that vane 13 is electrically isolated from the segments 29, 30 and 31. Referring to FIGS. 2 and 3, which are cross-sectional views taken along lines 2—2 and 3—3 respectively of FIG. 1, the vanes 12 and 14 are further electrically interconnected by a half-ring segment 29' in a mirror position to the segment 29. The segment 29' passes through a hole in vane 15 that is larger than the ring diameter and is thereby electrically isolated from the vane 15. The vanes 13 and 15 also are similarly further electrically interconnected by a half-ring segment 33', with a hole being provided in vane 14 that is larger than the segment thickness. Similar half-ring segments matching the segments 30, 31, 34, and 35, are also provided.

Provision of the half-ring segments (29–31), (29'–31'), (33–35) and (33'–35') in the RFQ structure 10 according to the invention has been found to bring all four quadrants of the structure 10 correctly into proper phase and to maintain the quadrants in proper phase over a wide range of thermal, mechanical and electrical variations. Moverover, rf energy may be coupled by a single loop 38 at the end of line 28 instead of at least two loops or coupling ports and a manifold as in the known art. The rf energy from the single loop 38 is evenly and stably distributed between the four quadrants within the stringent amplitude and phase requirements for RFQ structures. The one coupling loop 38 is sufficient for good coupling between all four quadrants of the RFQ structure 10 when the structure is provided with the half-ring segments in accordance with the invention. In addition, the half-ring segments permit any quadrant to be tuned individually to affect the resonant frequency of the RFQ structure 10, while in the known art the quadrants must be tuned simultaneously.

Figure 4:
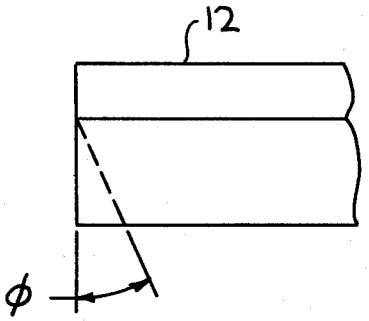
FIG. 4 is a side view of a vane of FIG. 1 indicating a representative angle at which the vane ends may be cut to axially tune the quadrupole structure, according to the invention.
Figure 5:
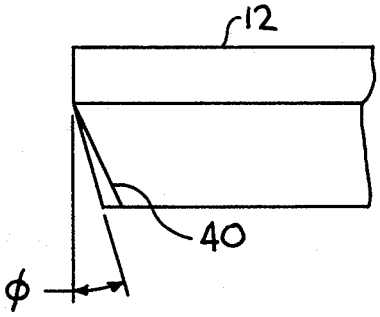
FIG. 5 is a view of the vane of FIG. 4 after the end is cut and with a shim or wedge added back to the cut portion of the vane to change the angle and thereby more finely tune the structure, according to the invention.

In the present invention, balancing of the axial field in the RFQ structure 10 may be performed simply, and with much less precision than is required in known structures to achieve good results. Balancing of the structure, when the invention is utilized, may be accomplished by trimming one end of each vane 12–15 prior to assembly of the structure 10. The end of the vane 12 (FIG. 4) may be trimmed at an angle $\phi$ and the vanes 13, 14 and 15 similarly trimmed. The angle $\phi$ is not critical. However, for convenience of tuning more precisely, the end may be overtrimmed and then a shim or wedge 40 (FIG. 5) appropriately fastened back onto the end to adjust the angle. The appropriate thickness for the wedge 40 may be determined experimentally by simply replacing wedges of different thicknesses on the vane ends to precisely balance the structure 10.

As discussed generally previously, for the designers of linear accelerators, radio frequency quadrupole structures are deemed desirable because of the unique use of RFQ's for simultaneously bunching, focusing, and accelerating ions that are moving much more slowly than the velocity of light. Successes at the Los Alamos National Laboratory with the RFQ structure have established the RFQ as a practical accelerator. Members of a Lawrence Berkeley Laboratory research team have simplified the construction of the Los Alamos National Laboratory RFQ accelerator. A test model cavity was constructed by the LBL team without initially incorporating the invention, from 8 inch-ID extruded aluminum pipe approximately 32 inches long with end walls of $\frac{1}{8}$ inch aluminum plate. The vanes were made of $\frac{1}{4}$ inch aluminum plate (a simplified structure for test purposes) with the ends rough cut at 45 degrees to the cavity wall, and they were installed in quadrature with an RF gasket. For a conventional operating RFQ particle accelerator structure, the vanes would be shaped in cross section as shown in FIG. 1. The vane edges that make up the gaps were machined to make an inner radius, from the cavity center to the vane edge, of 0.519 inches. Machined vane tip pieces (radius of curvature$=\frac{1}{8}$ inch) were attached to the edges of the vanes to make the inner radius approximately $\frac{1}{8}$ inch. The vane ends were 0.645 inches from the ends walls.

As set forth in the report LBL-13008 previously cited herein, several different modes, frequencies, and amplitude distributions were observed in the different quadrants, showing that the quadrants were not closely coupled when the invention was not utilized.

In the next part of the test, three sets of vane coupling rings, according to the invention, were installed to electrically connect opposing vanes together. The rings had a major diameter of 2 inches and a cross-section diameter of $\frac{1}{4}$ inch. The 2-inch diameter was very small compared to the wavelength of the cavity; hence, the ring inductance was negligible. Each ring was made in two segments in the shape of two semicircles. The locations of the end pairs of rings were $5\frac{1}{2}''$ along the length of the vanes from the vane ends to the ring diameter centers for the end rings, and $6\frac{1}{2}''$ to the ring diameter centers for the adjacent rings. The center pairs of rings were placed in the middle of the vane lengths and also spaced one inch apart.

The results of the tests performed on the RFQ structure in which the invention was incorporated showed that the vane coupling rings (VCR's), according to the invention, stabilized the RFQ structure and greatly enhanced its use as a practical accelerator. In particular, the VCR's completely eliminated dipole modes in the frequency range of interest (361–368 MHZ); the VCR's provided adequate quadrant balance with an initial mechnical alignment of the vanes; the VCR's enhanced the axial balance of the RFQ structure and enabled the use of simple end tuners; and the VCR's enabled the use of simplified RF drive and tuning apparatus.

While an embodiment of the invention has been shown and described, further embodiments or combinations of those described herein will be apparent to those skilled in the art without departing from the spirit of the invention.

What is claimed is:

1. A stabilized radio frequency quadrupole resonator of the long-vane type for simultaneously bunching, focusing and accelerating charged particles along a linear central path through said resonator, comprising:

means defining a radio frequency resonator cavity;

four radially equally spaced vanes elongated and continuous in the axial direction of said means, said vanes having a base end and a tip end, said base end being mounted on said defining means and extending therefrom for dividing said cavity into four equal sections to form the two pairs of opposing vanes; and means electrically interconnecting opposing ones of said plurality of vanes at substantially the same longitudinal axial point along said central path for stabilizing said resonator, said interconnecting means enabling said resonator to be tuned by adjustment of any one of said vanes to affect the resonant frequency, said interconnecting means eliminating undesirable dipole modes from the resonant frequency;

wherein said interconnecting means between opposing vanes electrically interconnects the tip ends of opposing vanes, said interconnecting means extending from opposing vanes through adjacent sections and holes in adjacent elongated vanes; and wherein said interconnecting means includes at least one pair of full-ring segments.

2. The resonator of claim 1, wherein said ring segments are mounted in full-ring pairs with a pair mounted at each end of said central path and a pair at the midpoint of said path.

3. The resonator of claim 1, further including means for driving said resonator, and means for coupling said driving means to said resonator at solely a single point in said cavity defining means.

4. The resonator of claim 3, wherein said coupling means includes a sole coupling port.

5. The resonator of claim 3, wherein said coupling means includes a sole coupling loop.

6. The resonator of claim 1, wherein said vanes are trimmed at an angle on at least one of their ends to axially balance and tune said resonator.

7. The resonator of claim 6, further including a shim added back onto at least said one trimmed vane end to precisely tune said resonator.

* * * * *